United States Patent [19]

Murray

[11] 4,130,060

[45] Dec. 19, 1978

[54] PYROTECHNIC DEVICES

[75] Inventor: Dudley C. Murray, Salisbury, England

[73] Assignee: Pains - Wessex Limited, England

[21] Appl. No.: 748,415

[22] Filed: Dec. 8, 1976

[30] Foreign Application Priority Data

Dec. 15, 1975 [GB] United Kingdom ..... 51325/75

[51] Int. Cl.[2] ..... F42B 4/02

[52] U.S. Cl. ..... 102/39; 102/28 M; 102/46

[58] Field of Search ..... 102/37.6, 39, 28 R, 102/28 M, 70.2; 174/50.55, 50.56

[56] References Cited

U.S. PATENT DOCUMENTS

| | | | |
|---|---|---|---|
| 512,320 | 1/1894 | Peil et al. | 174/50.55 |
| 621,291 | 3/1899 | Cazin | 174/50.56 |
| 1,937,220 | 11/1933 | Driggs, Jr. | 102/35.6 |
| 2,921,521 | 1/1960 | La Haye et al. | 102/39 |
| 3,780,656 | 12/1973 | Murray | 102/37.6 |

FOREIGN PATENT DOCUMENTS

| | | | |
|---|---|---|---|
| 6053 of | 1896 | United Kingdom | 102/46 |

*Primary Examiner*—Verlin R. Pendegrass

*Attorney, Agent, or Firm*—Leydig, Voit, Osann, Mayer & Holt, Ltd.

[57] ABSTRACT

The invention provides a pyrotechnic device comprising a casing containing an electrically-operable ignition device for igniting a charge, the ignition device comprising a base and an electric igniter head electrically connected to two spaced and mutually insulated terminals in the base. One terminal is disposed centrally within the base and the other terminal is located, at least in part, on the periphery of the base. The base is fitted within an opening in an electrically-conductive wall of the casing, the other terminal making electrical contact with this wall. Means are provided to prevent the ignition device from being ejected from the casing under the shock loading resulting from ignition of said charge.

12 Claims, 3 Drawing Figures

PYROTECHNIC DEVICES

This invention relates to pyrotechnic devices.

According to the present invention there is provided a pyrotechnic device comprising a casing containing an electrically-operable ignition device for igniting a charge, said ignition device comprising a base and an electric igniter head electrically connected to two spaced and mutually insulated terminals in said base, one terminal being disposed centrally within said base and the other terminal being located, at least in part, on the periphery of the base, the base fitting within an opening in an electrically-conductive wall of the casing and said other terminal making electrical contact with said wall, and means to prevent the ignition device from being ejected from the casing under the shock loading resulting from ignition of said charge.

The present invention also provides a pyrotechnic device comprising a casing containing an electrically-operable ignition device for igniting a charge, said ignition device comprising a base and an electric igniter head, the base comprising an electrically-conductive tubular member having a closure at one end, the closure comprising an annular electric insulator and a conductive terminal fitted within a central opening of the electric insulator, the electric igniter head being conductively connected to said terminal and to said tubular member, the base fitting within an opening in an electrically-conductive wall of the casing, and said tubular member making electrical contact with the conductive wall, and means to prevent the ignition device from being ejected from the casing under the shock loading resulting from ignition of said charge.

According to another aspect, the present invention provides a method of manufacture of a pyrotechnic device which includes the steps of forming an electrically-operable ignition device by electrically connecting an electric igniter head to two electrically-conductive terminals, locating one of said conductive terminals centrally within an annular body of electrically insulative material, locating the other terminal at the periphery of said body of insulative material, fitting said ignition device into an opening in an electrically-conductive wall of a casing of the pyrotechnic device to make electric contact between said other terminal and said wall, and sealing the ignition device to said wall.

The invention will now be particularly described with reference to the accompanying drawings in which.

Figure 1:
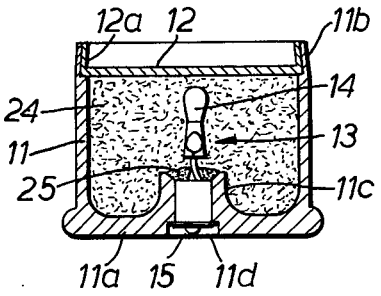
FIG. 1 is a section through a flash cartridge in accordance with the present invention.

The flash cartridge shown in the drawings comprises a tubular casing 11, of aluminium or other electrically-conductive material, having an integral end wall 11*a* at one end, the opposite end being closed by a top cap 12 of aluminium or other suitable material after fitting of an ignition device 13 and insertion of an ignitable charge 24. The top cap 12 is of dished shape and is secured in position by rolling the open end portion 11*b* of the casing inwardly into contact with a peripheral flange 12*a* of the top cap.

The ignitable charge and other features of the flash cartridge, apart from the ignition device, form no part of the present invention.

Figure 2:
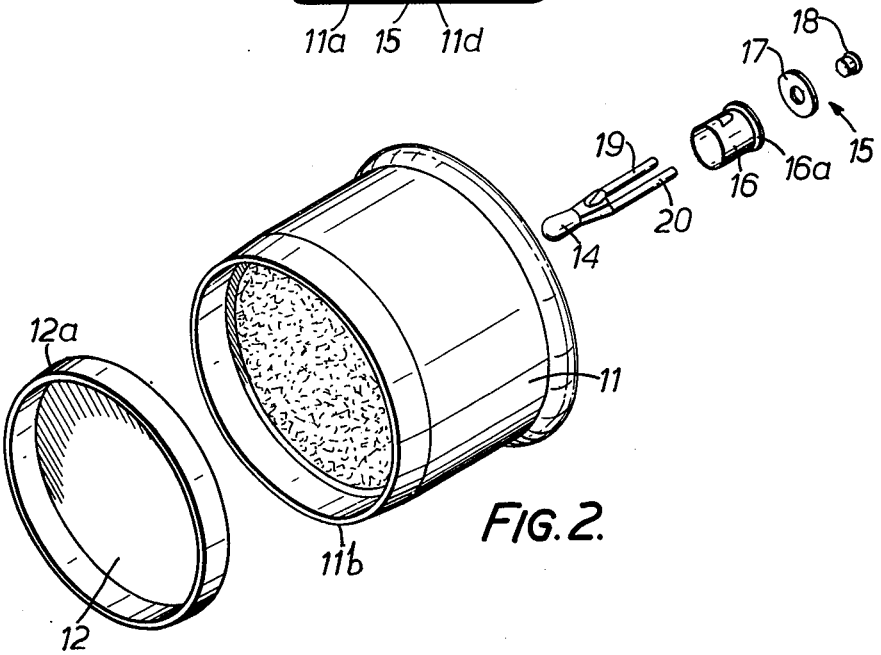
FIG. 2 is an exploded perspective view of the cartridge of FIG. 1 showing the assembly of an electric ignition device of the cartridge.

The ignition device 13 comprises an electric igniter head 14, conveniently of the type known as a "match head fuse" in which a wire is surrounded by a composition which combusts when a suitable current passes through the wire, the igniter head being supported on a base 15 fitted to the cartridge. In the ignition device shown in FIG. 2, the base comprises an electrically-conductive tube 16 which is flanged at one end, and a closure at this end formed by an annular disc 17 of insulating material at the centre of which is an electrically-conductive terminal 18. Conductive leads 19, 20 from the igniter head are soldered or otherwise secured respectively to the conductive tube 16 and the central terminal 18.

At the centre of the end wall 11*a* of the casing is an opening surrounded by a sleeve 11*c* which is integral with the end wall and extends on the inside of the casing. The ignition device is fitted into this sleeve until a flange 16*a* on the periphery of the tube engages the base of a recess 11*d* in the end wall of the casing surrounding the opening, the depth of this recess being such as to bring the central terminal 18 substantially flush with the outer surface of the end wall 11*a* of the casing. After insertion, the ignition device is sealed and secured in the opening by an epoxy resin or other suitable adhesive which is applied at 25 over the adjacent open ends of the tube 16 and the sleeve 11*c* so that the adhesive also enters the tube, and advantageously fills the tube. This adhesive, preferably shaped as a tapered plug, will bond the base of the ignition device to the sleeve 11*c* sufficiently securely to prevent the ignition device from being ejected from the sleeve under the high shock loading resulting from ignition of the ignitable charge. It will also act as a sealant therebetween.

Figure 3:
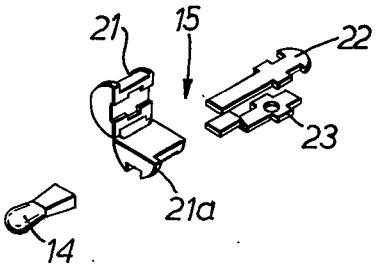
FIG. 3 is an exploded perspective view of a modification of the ignition device shown in FIG. 2.

In the alternative form of ignition device shown in FIG. 3, the base 15 comprises a cylindrical body 21 of electrically-insulating material, which is split on an axial plane, and two spade-like terminals 22, 23 extending from the igniter head 14, the centre terminal 22 being received in a correspondingly shaped recess in the axial plane of one half of the body 21, and the second terminal 23 being received in a correspondingly shaped recess in the periphery of the body 21 so that the second terminal, at least in part, lies in the periphery of the base. Accordingly the second terminal 23 will make electrical contact with the end wall 11*a* of the casing after the ignition device has been fitted. In this modification, the body 21 is seen to have a peripheral flange 21*a* at its end adjacent the igniter head 14. The ignition device will therefore be fitted into position from within the casing and the peripheral flange 21*a* will abut the end of sleeve 11*c* and prevent or assist in preventing the ignition device from being forced out of the casing upon ignition. As in the case of the first alternative, the ignition device is sealed within the opening by sealant or adhesive applied over the adjacent ends of the body 21 and of the sleeve 11*c*.

Although the invention has been described above in relation to a flash cartridge, it is also applicable to other types of pyrotechnic device which make use of an electrically-operated ignition device, for example a cartridge containing a smoke or flare composition, a star or stars, or a rocket device.

I claim:

1. A pyrotechnic device comprising a casing having an electrically-conductive wall,
an electrically-operable ignition device in said casing for igniting a charge,
said ignition device comprising
a base,
a first terminal disposed centrally within said base,
a second terminal spaced from the first terminal and located, at least in part, on the periphery of the base,
means electrically insulating the terminals from each other,
an electric igniter head and
means electrically connecting the igniter head to the first and second terminals,
the base fitting within an opening in said electrically-conductive wall of the casing, and
said second terminal making electrical contact with said wall, and
a plug of solid adhesive material disposed within the inner end of said opening and adhering to the base and the said wall of the casing to seal the base to said wall of the casing to prevent escape of gases therebetween, to prevent the ignition device from being ejected from the casing under the shock loading resulting from ignition of said charge and to relieve the ignition device from at least part of said shock loading.

2. A pyrotechnic device comprising
a casing having an electrically-conductive wall,
an electrically-operable ignition device in said casing for igniting a charge,
said ignition device comprising
a base and
an electric igniter head,
the base comprising
an electrically-conductive tubular member,
a closure at one end of said tubular member,
the closure comprising
an annular electric insulator and
a conductive terminal fitted within a central opening of the electric insulator,
means conductively connecting the electric igniter head to said terminal and to said tubular member,
the base fitting within an opening in said electrically-conductive wall of the casing, and
said tubular member making electrical contact with the conductive wall, and
a plug of solid adhesive material disposed within the inner end of said opening and adhering to the base and the said wall of the casing to seal the base to said wall of the casing to prevent escape of gases therebetween, to prevent the ignition device from being ejected from the casing under the shock loading resulting from ignition of said charge and to relieve the ignition device from at least part of said shock loading.

3. A pyrotechnic device according to claim 2 wherein the tubular member has a peripheral flange at its closed end, to abut against said wall of the casing.

4. A pyrotechnic device according to claim 1 wherein a sleeve formed integrally with said wall on the inside of the casing receives the base therein.

5. A pyrotechnic device according to claim 4 wherein said adhesive material has been applied over a surface of the sleeve so shaped that the resulting plug of adhesive material is tapered.

6. A pyrotechnic device according to claim 1 wherein said base comprises a body of electrically-insulating material.

7. A pyrotechnic device according to claim 1 wherein the means to prevent the ignition device from being ejected from the casing comprises a flange on the base in engagement with the inside of said wall of the casing.

8. A pyrotechnic device according to claim 1 wherein said electrically-conductive wall forms an integral end wall of an electrically-conductive tubular casing.

9. A pyrotechnic device according to claim 1 in the form of a flash cartridge wherein the casing is tubular and the said wall forms the end wall of the cartridge.

10. A method of manufacture of a pyrotechnic device which includes the steps of
forming an electrically-operable ignition device by electrically connecting an electric igniter head to two electrically-conductive terminals,
locating one of said conductive terminals centrally within an annular body of electrically insulative material,
locating the other terminal at the periphery of said body of insulative material,
fitting said ignition device into an opening in an electrically-conductive wall of a casing of the pyrotechnic device to make electric contact between said other terminal and said wall, and
sealing the ignition device to said wall by the application of a plug of hardenable adhesive material within said opening to bridge the opening and forming a coating in contact both with said wall of the casing and the ignition device.

11. A method according to claim 10 wherein the plug is formed by a mass of epoxy resin or other hardenable adhesive which protects the ignition device from damage due to shock and prevents the ignition device from being ejected.

12. A pyrotechnic device comprising
a casing having an electrically-conductive wall,
an electrically-operable ignition device in said casing for igniting a charge,
said ignition device comprising
a base,
a first terminal disposed centrally within said base,
a second terminal spaced from the first terminal and located, at least in part, on the periphery of the base,
means electrically insulating the terminals from each other,
an electric igniter head and
means electrically connected the igniter head to the first and second terminals,
the base fitting within an opening in said electrically-conductive wall of the casing and
said second terminal making electrical contact with said wall, and
a solid mass of adhesive material extending around the periphery of the base in bonding contact with the base and the said wall of the casing to prevent the ignition device from being ejected from the casing under the shock loading resulting from ignition of said charge, the mass of adhesive material being in gas sealing relationship with the base and the said wall of the casing.

* * * * *